United States Patent [19]

Haase

[11] 4,256,236

[45] Mar. 17, 1981

[54] COLLAPSIBLE CONTAINER FOR MILK CARTONS

[76] Inventor: Samuel Haase, 61-20 Grand Central Pkwy., Forest Hills, N.Y. 11375

[21] Appl. No.: 88,948

[22] Filed: Oct. 29, 1979

[51] Int. Cl.[3] ..... B65D 8/14; B65D 6/16

[52] U.S. Cl. ..... 220/6; 220/4 F; 229/41 R

[58] Field of Search ..... 220/4 F, 6

[56] References Cited

U.S. PATENT DOCUMENTS

| | | | |
|---|---|---|---|
| 2,221,504 | 11/1940 | Beasley et al. | 220/6 |
| 2,914,210 | 11/1959 | Paston | 220/6 |
| 3,266,656 | 8/1966 | Kridle | 220/4 F |
| 3,371,816 | 3/1968 | Ricci | 220/4 F |
| 3,376,994 | 4/1968 | Flinn, Jr. | 220/6 |
| 3,611,994 | 10/1971 | Bailey | 220/6 X |
| 3,974,934 | 8/1976 | Rohner | 220/4 F |
| 4,014,292 | 3/1977 | Coughlin et al. | 220/6 X |
| 4,165,024 | 8/1979 | Oswalt et al. | 220/4 F X |
| 4,171,058 | 10/1979 | Collins | 220/4 F X |

*Primary Examiner*—Davis T. Moorehead
*Attorney, Agent, or Firm*—Daniel J. Tick

[57] ABSTRACT

A collapsible container for milk cartons has a plate-like base member with first and second spaced parallel edges and third and fourth spaced parallel edges perpendicular to the first and second edges. First and second upper ledges extends upward perpendicularly from the base member along the first and second edges thereof. Third and fourth upper ledges extend upward perpendicularly from the base member along the third and fourth edges thereof. The third and fourth upper ledges are perpendicular to the first and second upper ledges. A first side panel is pivotally mounted in the third and fourth upper ledges next-adjacent the first upper ledge in a manner whereby the first upper ledge prevents the first side panel from falling outward. A second side panel is pivotally mounted in the third and fourth upper ledges next-adjacent the second upper ledge in a manner whereby the second upper ledge prevents the second side panel from falling outward. A third side panel is pivotally mounted in the first and second upper ledges next-adjacent the third upper ledge in a manner whereby the third upper ledge prevents the second side panel from falling outward. A fourth side panel is pivotally mounted in the first and second upper ledges next-adjacent the fourth upper ledge in a manner whereby the fourth upper ledge prevents the fourth side panel from falling outward. The side panels are maintained upright by milk cartons supported on the base member and collapse inward toward the base member in the absence of milk cartons on the base member.

6 Claims, 7 Drawing Figures

COLLAPSIBLE CONTAINER FOR MILK CARTONS

BACKGROUND OF THE INVENTION

The present invention relates to a collapsible container. More particularly, the invention relates to a collapsible container for milk cartons.

Containers or cases for 20 or 24 cartons of milk are used in making milk deliveries. In past years, when milk was delivered in glass bottles, the containers were made of strong wood and steel. These days, the containers are very strong, sturdy boxes of plastic. The containers are very well constructed and are durable, since they are handled, at the milk processing plant, by hand and fork lift trucks and must be stackable on each other and on pallets.

For years, people have been appropriating the milk company cases, containers or boxes for their own use, because of their great structural strength. The boxes are privately used to support very heavy objects such as automotive vehicles, for the storage of articles and objects, as individual seats or benches, and for many other purposes. Almost every private garage has at least one or more milk boxes in it. The milk companies thus lose many thousands of boxes, and therefore many thousands of dollars, each year.

The principal object of the invention is to provide a collapsible container for milk cartons, which container is structurally strong enough to carry milk, but collapses in the absence of milk cartons therein.

An object of the invention is to provide a collapsible container for milk cartons, which container is sturdy when milk cartons are stored therein and may be stacked and carried on pallets by fork lift trucks, but collapses in the absence of milk cartons therein.

Another object of the invention is to provide a collapsible container for milk cartons, which container functions as a known box when it carries milk cartons, permits easy handling thereof and protects such cartons from damage in handling, but, in the absence of milk cartons, collapses to a minimum size and area.

Still another object of the invention is to provide a collapsible container for milk cartons, which container functions efficiently, effectively and reliably to carry and store milk cartons without difficulty, but collapses, and is essentially useless for any purpose when there are no milk cartons in it.

Yet another object of the invention is to provide a collapsible container for milk cartons, which container is inexpensive in manufacture, of simple structure, useless for anything but storing and carrying cartons of milk, and collapses to a minimum size and area in the absence of milk cartons, so that it occupies considerably less storage space than conventional milk boxes.

Another object of the invention is to provide a collapsible container for milk cartons, which container, when not carrying milk cartons, collapses to a size and area about one fifth that of a conventional milk box or case, so that five or six of the collapsed containers are stackable in the space occupied by one conventional milk box and are easily handled, on a pallet, by a fork lift truck and provide considerably more "walking" space in milk processing plants and in milk delivery trucks.

BRIEF SUMMARY OF THE INVENTION

In accordance with the invention, a collapsible container for milk cartons comprises a plate-like base member having first and second spaced parallel edges and third and fourth spaced parallel edges perpendicular to the first and second edges. First and second ledges extend substantially perpendicularly from the base member along the first and second edges thereof and third and fourth ledges extend substantially perpendicularly from the base member along the third and fourth edges thereof. The third and fourth ledges are substantially perpendicular to the first and second ledges. A first side panel is pivotally mounted in the third and fourth ledges next-adjacent the first ledge in a manner whereby the first ledge prevents the first side panel from falling outward. A second side panel is pivotally mounted in the third and fourth ledges next-adjacent the second ledge in a manner whereby the second ledge prevents the second side panel from falling outward. A third side panel is pivotally mounted in the first and second ledges next-adjacent the third ledge in a manner whereby the third ledge prevents the third side panel from falling outward. A fourth side panel is pivotally mounted in the first and second ledges next-adjacent the fourth ledge in a manner whereby the fourth ledge prevents the fourth side panel from falling outward. The side panels are maintained upright by milk cartons supported on the base member and collapse inward toward the base member in the absence of milk cartons on the base member.

The base member is of rectangular configuration.

Each of the side panels has a bottom edge of predetermined length adjacent the base member, a top edge shorter than the predetermined length spaced from and substantially parallel to the bottom edge and a pair of side edges tapering down from the bottom edge to the top edge.

Each of the first and second ledges is of elongated rectangular configuration having a bottom edge coincident with the first and second edges, respectively, of the base member and a top edge in spaced substantially parallel relation with the bottom edge and spaced from the base member. A first hole is formed therethrough adjacent the top edge thereof and the third ledge and a second hole is formed therethrough adjacent the top edge thereof and the fourth ledge and colinear with the first hole. Each of the third and fourth ledges is of elongated rectangular configuration having a bottom edge coincident with the third and fourth edges, respectively, of the base member and a top edge in spaced substantially parallel relation with the bottom edge and spaced from the base member. A first hole is formed therethrough adjacent the bottom edge thereof and the first ledge and a second hole is formed therethrough adjacent the bottom edge thereof and the second ledge and colinear with the first hole. Each of the first and second side panels has a first pin extending from one side edge thereof in substantially parallel relation with the bottom edge thereof spaced a predetermined distance from the bottom edge and a second pin extending from the other side edge thereof in substantially parallel relation with the bottom edge thereof spaced the predetermined distance from the bottom edge and colinear with the first pin. The first and second pins are accommodated in the first and second holes, respectively, of the third and fourth ledges whereby the first and second side panels are pivotally mounted on the base member. Each of the third and fourth sides has a first pin extending from one side edge thereof in substantially parallel relation with the bottom edge thereof spaced a distance greater than the predetermined distance from the bottom edge and a second pin extending from the other side edge thereof in substantially parallel relation with the bottom edge thereof spaced the same distance as the first pin from the bottom edge and colinear with the first pin. The first and second pins of the third and fourth side panels are accommodated in the first and second holes, respectively, of the first and second ledges whereby the third and fourth side panels are pivotally mounted on the base member.

Each of the first and second side panels has a hand slot formed therethrough in spaced substantially parallel relation with the top edge thereof for accommodating a hand of a holder of the container.

BRIEF DESCRIPTION OF THE DRAWINGS

In order that the invention may be readily carried into effect, it will now be described with relation to the accompanying drawings, wherein.

DETAILED DESCRIPTION OF THE INVENTION

The collapsible container of the invention comprises a plate-like base member 1 of rectangular configuration (FIGS. 1 and 2) having first and second spaced parallel edges 2 and 3 (FIG. 2) and third and fourth spaced parallel edges 4 and 5 (FIG. 2) perpendicular to said first and second edges.

Figure 1:
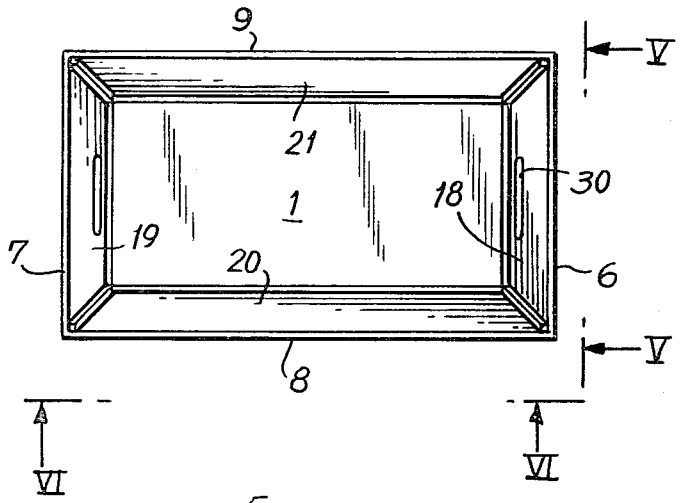
FIG. 1 is a top plan view of an embodiment of the collapsible container of the invention.

First and second upper ledges 6 and 7 extend upward substantially perpendicularly from the base member 1 along the first and second edges 2 and 3, respectively, thereof, as shown in FIG. 1. Third and fourth upper ledges 8 and 9 extend upward substantially perpendicularly from the base member 1 along the third and fourth edges 4 and 5, respectively, thereof, as shown in FIG. 1.

The third and fourth upper ledges 8 and 9 are substantially perpendicular to the first and second upper ledges 6 and 7, as shown in FIG. 1.

Each of the first and second upper ledges 6 and 7 is of elongated rectangular configuration (FIGS. 4 and 5) having a bottom edge 10 coincident with the first and second edges 2 and 3, respectively (FIGS. 4 and 5), of the base member 1. The first and second upper ledges 6 and 7 are identical and each has a top edge 11 (FIGS. 4 and 5) in spaced substantially parallel relation with the bottom edge 10 and spaced from the base member 1.

Figure 4:
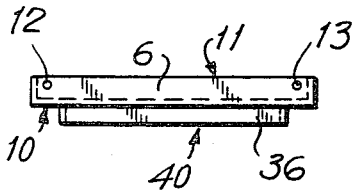
FIG. 4 is an end view, taken along the lines IV—IV, of FIG. 2.
Figure 5:
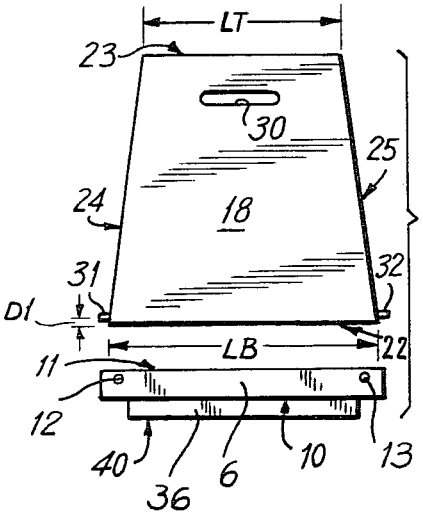
FIG. 5 is an end view, taken along the lines V—V, of FIG. 1, with the side separated from the base member.

A first hole 12 is formed through each of the first and second upper ledges 6 and 7, adjacent the top edge 11 thereof, as shown in FIGS. 4 and 5, and the third upper lip 8. A second hole 13 is formed through each of the first and second upper ledges 6 and 7, adjacent the top edge 11 thereof, as shown in FIGS. 4 and 5, and the fourth upper ledge 9. The first and second holes 12 and 13 are colinear.

Each of the third and fourth upper ledges 8 and 9 is of elongated rectangular configuration (FIGS. 3 and 6) having a bottom edge 14 coincident with the third and fourth edges 4 and 5, respectively (FIGS. 3 and 6), of the base member 1. The third and fourth upper ledges 8 and 9 are identical and each has a top edge 15 (FIGS. 3 and 6) in spaced substantially parallel relation with the bottom edge 14 and spaced from the base member 1.

Figure 3:
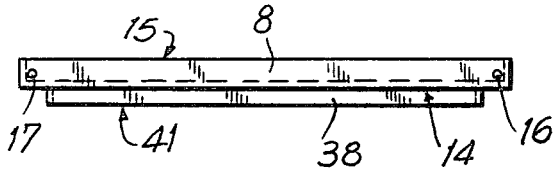
FIG. 3 is a side view, taken along the lines III—III, of FIG. 2.
Figure 6:
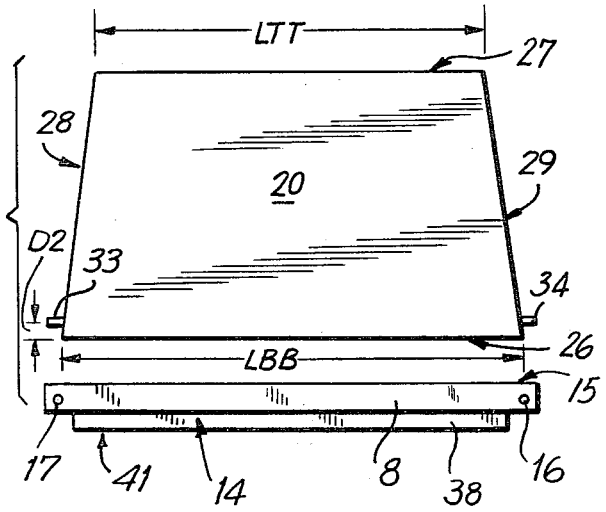
FIG. 6 is a side view, taken along the lines VI—VI, of FIG. 1, with the side separated from the base member.

A first hole 16 is formed through each of the third and fourth upper ledges 8 and 9, adjacent the bottom edge 14 thereof, as shown in FIGS. 3 and 6, and the first upper ledge 6. A second hole 17 is formed through each of the third and fourth upper ledges 8 and 9, adjacent the bottom edge 14 thereof, as shown in FIGS. 3 and 6, and the second upper ledge 7. The first and second holes 16 and 17 are colinear.

A first side panel 18 (FIGS. 1 and 5) is pivotally mounted in the third and fourth upper ledges 8 and 9, next-adjacent the first ledge 6, in a manner whereby said panel first ledge prevents said first side from falling outward. This is accomplished by pins of the first side panel 18 and the first holes 16 of the third and fourth upper ledges 8 and 9, as hereinafter explained.

A second side panel 19 (FIG. 1) is pivotally mounted in the third and fourth upper ledges 8 and 9, next-adjacent the second upper ledge 7, in a manner whereby said second upper ledge prevents said second side panel from falling outward. This is accomplished by pins of the second side panel 19 and the second holes 17 of the third and fourth upper ledges 8 and 9, as hereinafter explained. The first and second side panels 18 and 19 are identical.

A third side panel 20 (FIGS. 1 and 6) is pivotally mounted in the first and second upper ledges 6 and 7, next-adjacent the third upper ledge 8, in a manner whereby said third upper ledge prevents said third side panel from falling outward. This is accomplished by pins of the third side panel 20 and the first holes 12 of the first and second upper ledges 6 and 7, as hereinafter explained.

A fourth side 21 (FIG. 1) is pivotally mounted in the first and second upper ledges 6 and 7, next-adjacent the fourth ledge 9, in the manner whereby said fourth upper ledge prevents said fourth side panel from falling outward. This is accomplished by pins of the fourth side panel 21 and the second holes 13 of the first and second upper ledges 6 and 7, as hereinafter explained. The third and fourth side panels 20 and 21 are identical.

The side panels 18, 19, 20 and 21 are maintained upright by milk cartons (not shown in the FIGS.) supported on the base member 1 and collapse inward toward said base member in the absence of milk cartons on said base member. This destroys the attractiveness of the container to people who would otherwise appropriate it for various uses to which a very sturdy box would be put. In the collapsed condition of the container, the first side panel 18 may lie in abutment with the base member 1, the second side panel 19 may lie in abutment with said first side panel, the third side panel 20 may lie in abutment with said second side panel, and the fourth side panel 21 may lie in abutment with said third side panel. The collapsed container thus is of a minimum size and occupies a minimum space or area equal to about one fifth or one sixth the space occupied by a conventional milk box or case.

Each of the first and second side panels 18 and 19 has a bottom edge 22 of predetermined length LB adjacent the base member 1, a top edge 23 of a length LT shorter than the predetermined length LB, spaced from and substantially parallel to said bottom edge, and a pair of side edges 24 and 25, tapering down from said bottom edge to said top edge, as shown in FIG. 5.

Each of the third and fourth side panels 20 and 21 has a bottom edge 26 of predetermined length LBB adjacent the base member 1, a top edge 27 of a length LTT shorter than the predetermined length LBB, spaced from and substantially parallel to said bottom edge, and a pair of side edges 28 and 29, tapering down from said bottom edge to said top edge, as shown in FIG. 6.

The side panels 18, 19, 20 and 21 are tapered in the aforedescribed manner to prevent their upper corners from being conveniently affixed to each other. This prevents their use as boxes by those who covet them and thus discourages theft of the container of the invention.

Each of the first and second side panels 18 and 19 has a hand slot 30 formed therethrough in spaced substantially parallel relation with the top edge 23 thereof, as shown in FIG. 5, for accommodating a hand of a holder of the container.

Each of the first and second side panels 18 and 19 has a first pin 31 extending from the side edge 24 thereof (FIG. 5) in substantially parallel relation with the bottom edge 22 thereof. The first pin 31 is spaced a predetermined distance D1 from the bottom edge 22 (FIG. 5). A second pin 32 extends from the side edge 25 of the first and second side panels 18 and 19 (FIG. 5) in substantially parallel relation with the bottom edge 22 thereof. The second pin 32 is spaced the same distance D1 from the bottom edge 22, and is colinear with the first pin 31.

Each of the third and fourth side panels 20 and 21 has a first pin 33 extending from the side edge 28 thereof (FIG. 6) in substantially parallel relation with the bottom edge 26 thereof. The first pin 33 is spaced a distance D2 greater than the distance D1 from the bottom edge 26 (FIG. 6). A second pin 34 extends from the side edge 29 of the third and fourth side panels 20 and 21 (FIG. 6) in substantially parallel relation with the bottom edge 26 thereof. The second pin 34 is spaced the same distance D2 from the bottom edge 26, and is colinear with the first pin 33.

The first and second pins 31 and 32 of the first side panel 18 are accommodated in the first holes 16 of the third and fourth upper ledges 8 and 9. The first and second pins 31 and 32 of the second side panel 19 are accommodated in the second holes 17 of the third and fourth upper ledges 8 and 9. The first and second pins 33 and 34 of the third side panel 20 are accommodated in the first holes 12 of the first and second upper ledges 6 and 7. The first and second pins 33 and 34 of the fourth side panel 21 are accommodated in the second holes 13 of the first and second upper ledges 6 and 7.

Thus, the first and second sides 18 and 19 are pivotally mounted on the third and fourth upper ledges 8 and 9 of the base member 1, and the third and fourth side panels 20 and 21 are pivotally mounted on the first and second upper ledges 6 and 7 of said base member. The side panels 18, 19, 20 and 21 are thus retained in upright position only when the container has cartons of milk therein. When there are no cartons of milk in the container, the side panels 18, 19, 20 and 21 collapse inward toward the base member 1 and the container is useless as such.

Figure 2:
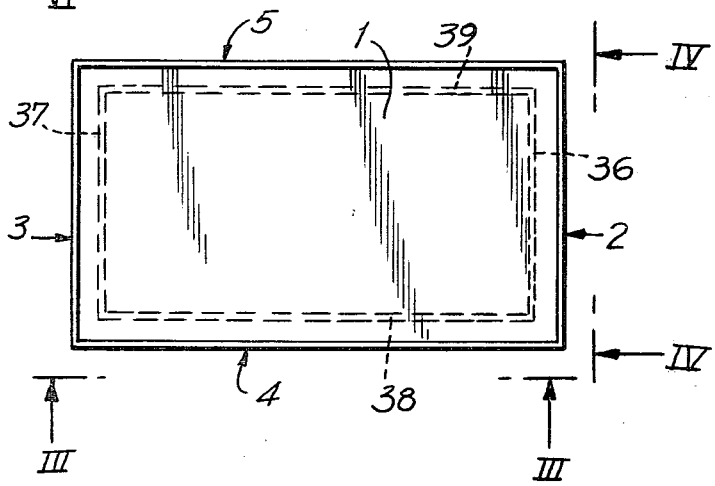
FIG. 2 is a top plan view of the base member of the embodiment of FIG. 1.
Figure 7:
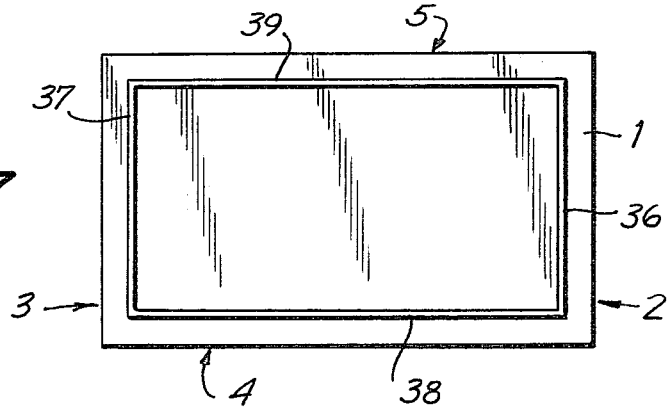
FIG. 7 is a bottom view of the base member of the embodiment of FIG. 1.

First and second lower ledges 36 and 37 extend downward substantially perpendicularly from the base member 1 in spaced parallel relation with the first and second edges 2 and 3, respectively, thereof, as shown in FIGS. 2 and 7. Third and fourth lower ledges 38 and 39 extend downward substantially perpendicularly from the base member 1 in spaced parallel relation with the third and fourth edges 4 and 5, respectively, thereof, as shown in FIGS. 2 and 7.

The third and fourth lower ledges 38 and 39 are substantially perpendicular to the first and second lower ledges 36 and 37, as shown in FIGS. 2 and 7.

Each of the first and second lower ledges 36 and 37 is of elongated rectangular configuration (FIGS. 4 and 5). The first and second lower ledges 36 and 37 are identical and each has a bottom edge 40 (FIGS. 4 and 5) in spaced substantially parallel relation with the bottom of the base member 1.

Each of the third and fourth lower ledges 38 and 39 is of elongated rectangular configuration (FIGS. 3 and 6). The third and fourth lower ledges 38 and 39 are identical and each has a bottom edge 41 (FIGS. 3 and 6) in spaced substantially parallel relation with the bottom of the base member 1.

The lower ledges 36, 37, 38 and 39 permit the container of the invention to be stacked, one on another, since the lower ledges maintain the upright side panels of the next-lower container strongly in position and prevent said side panels from collapsing inward even when there are no items in said next-lower container.

While the invention has been described by means of a specific example and in a specific embodiment, I do not wish to be limited thereto, for obvious modifications will occur to those skilled in the art without departing from the spirit and scope of the invention.

I claim:

1. A collapsible container, said container comprising a plate-like base member having first and second spaced parallel edges and third and fourth spaced parallel edges perpendicular to the first and second edges, first and second upper ledges extending upward substantially perpendicularly from said base member along the first and second edges thereof and third and fourth upper ledges extending upward substantially perpendicularly from said base member along the third and fourth edges thereof, said third and fourth upper ledges being substantially perpendicular to said first and second upper ledges, each of said first, second, third and fourth upper ledges having spaced opposite first and second ends with a first hole formed therethrough at the first end and a second hole formed therethrough at the second end;

a first side panel pivotally mounted in said third and fourth upper ledges next-adjacent said first upper ledge in a manner whereby said first upper ledge prevents the first side panel from falling outward;

a second side panel pivotally mounted in said third and fourth upper ledges next-adjacent said second upper ledge in a manner whereby said second upper ledge prevents the second side panel from falling outward;

a third side panel pivotally mounted in said first and second upper ledges next-adjacent said third upper ledge in a manner whereby said third upper ledge prevents the third side panel from falling outward; and a fourth side panel pivotally mounted in said first and second upper ledges next-adjacent said fourth upper ledge in a manner whereby said fourth upper ledge prevents the fourth side panel from falling outward, said side panels being maintained upright by cartons supported on said base member and collapsing inward toward said base member in the absence of cartons on said base member, each of said first, second, third and fourth side panels having a pair of spaced opposite side edges, a first pin extending from one of said side edges and accommodated in a corresponding hole through a corresponding one of said upper ledges and a second pin extending from the other of said side edges and accommodated in a corresponding hole through a corresponding other of said upper ledges.

2. A collapsible container as claimed in claim 1, wherein each of said side panels has a bottom edge of predetermined length adjacent said base member, a top edge shorter than the predetermined length spaced from and substantially parallel to the bottom edge and a pair of side edges tapering down from the bottom edge to the top edge.

3. A collapsible container as claimed in claim 2, wherein each of said first and second upper ledges is of elongated rectangular configuration having a bottom edge coincident with the first and second edges, respectively, of said base member, a top edge in spaced substantially parallel relation with the bottom edge and spaced from said base member, a first hole formed therethrough adjacent the top edge thereof and the third upper ledge and a second hole formed therethrough adjacent the top edge thereof and the fourth upper ledge and colinear with said first hole, each of said third and fourth upper ledges is of elongated rectangular configuration having a bottom edge coincident with the third and fourth edges, respectively, of said base member, a top edge in spaced substantially parallel relation with the bottom edge and spaced from said base member, a first hole formed therethrough adjacent the bottom edge thereof and the first upper ledge and a second hole formed therethrough adjacent the bottom edge thereof and the second upper ledge and colinear with said first hole.

4. A collapsible container as claimed in claim 2, wherein each of said first and second side panels has a hand slot formed therethrough in spaced substantially parallel relation with the top edge thereof for accommodating a hand of a holder of said container.

5. A collapsible container as claimed in claim 3, wherein each of said first and second side panels has a first pin extending from one side edge thereof in substantially parallel relation with the bottom edge thereof spaced a predetermined distance from said bottom edge and a second pin extending from the other side edge thereof in substantially parallel relation with the bottom edge thereof spaced the predetermined distance from said bottom edge and colinear with said first pin, said first and second pins being accommodated in the first and second holes, respectively, of said third and fourth upper ledges whereby said first and second side panels are pivotally mounted on said base member, and each of said third and fourth side panels has a pin extending from one side edge thereof in substantially parallel relation with the bottom edge thereof spaced a distance greater than said predetermined distance from said bottom edge and a second pin extending from the other side edge thereof in substantially parallel relation with the bottom edge thereof spaced the same distance as the first pin from said bottom edge and colinear with said first pin, said first and second pins of said third and fourth side panels being accommodated in the first and second holes, respectively, of said first and second upper ledges whereby said third and fourth side panels are pivotally mounted on said base member.

6. A collapsible container as claimed in claim 1, further comprising first and second lower ledges extending downward substantially perpendicularly from said base member in spaced parallel relation with said first and second edges thereof and third and fourth lower ledges extending downward substantially perpendicularly from said base member in spaced parallel relation with said third and fourth edges thereof, said third and fourth lower ledges being substantially perpendicular to said first and second lower ledges, said lower ledges permitting said collapsible container to be stacked, one on another, by maintaining upright side panels of a next-lower one of said collapsible container from collapsing inwardly.

* * * * *